US005503124A

United States Patent [19]

Wallis

[11] Patent Number: 5,503,124

[45] Date of Patent: Apr. 2, 1996

[54] ROTARY VALVE WITH SEAL SUPPORTING TONGUE

[75] Inventor: Anthony B. Wallis, Gladesville, Australia

[73] Assignee: A. E. Bishop Research Pty. Limited, North Ryde, Australia

[21] Appl. No.: 424,438

[22] PCT Filed: Nov. 3, 1993

[86] PCT No.: PCT/AU93/00571

§ 371 Date: May 5, 1995

§ 102(e) Date: May 5, 1995

[87] PCT Pub. No.: WO94/11621

PCT Pub. Date: May 26, 1994

[30] Foreign Application Priority Data

Nov. 6, 1992 [AU] Australia ..... PL5731

[51] Int. Cl.[6] ..... F01L 7/02

[52] U.S. Cl. ..... 123/190.1; 123/190.8; 123/190.2; 123/80 BA

[58] Field of Search ..... 123/190.1, 190.4, 123/190.6, 190.8, 190.16, 190.17, 190.2, 80 BA

[56] References Cited

U.S. PATENT DOCUMENTS

| | | | |
|---|---|---|---|
| 3,871,340 | 3/1975 | Zimmerman | 123/190.17 |
| 4,019,487 | 4/1977 | Guenther | 123/190.17 |
| 4,852,532 | 8/1989 | Bishop | 123/190.8 |
| 5,074,265 | 12/1991 | Ristin et al. | 123/190.8 |
| 5,095,870 | 3/1992 | Place et al. | 123/190.8 |
| 5,152,259 | 10/1992 | Bell | 123/190.2 |
| 5,154,147 | 10/1992 | Musoki | 123/190.17 |
| 5,255,645 | 10/1993 | Templeton | 123/190.17 |

FOREIGN PATENT DOCUMENTS

| | | | |
|---|---|---|---|
| 0112069 | 6/1984 | European Pat. Off. | 123/190.17 |
| 1041691 | 10/1953 | France | 123/190.17 |

*Primary Examiner*—David A. Okonsky

*Attorney, Agent, or Firm*—Nikaido, Marmelstein, Murray & Oram

[57] ABSTRACT

A rotary valve (10) for an internal combustion engine, of the hollow cylindrical type, having one or more openings (14) arranged to pass periodically over a window in the cylinder head bore, characterized in that the valve (10) also incorporates at least one tongue (34) projecting from the axially central point of the leading edge of at least one of the openings (14), the external surface of the tongue (34) having the same profile as the outer cylindrical surface (35) of the valve (10), the tongue (34) extending from the leading edge (24) of the opening (14) to an extent sufficient to support the center of an axially extending seal during that period when the leading edge (24) of the opening (14) crosses such seal.

5 Claims, 6 Drawing Sheets

ROTARY VALVE WITH SEAL SUPPORTING TONGUE

The present invention relates to improvements in rotary valves for internal combustion engines.

The invention is applicable to rotary valves of the kind in which a valve is supported for rotation in a bore in a cylinder head by means of bearings that serve to maintain a small running clearance between the rotary valve and the bore, there being in the circumferential surface of the rotary valve one or more openings leading to a port or ports in the valve which, as the valve rotates are brought into coincidence with a window in the cylinder head leading to the combustion chamber of the engine. In such arrangements gas leakage from the combustion chamber in a circumferential direction around the valve is prevented by means of axially extending sealing members arranged in grooves in the cylinder head and spring loaded into contact with the circumferential surface of the rotary valve. Such axial seals are arranged on each side of the window in the cylinder head.

As is explained in greater detail in connection with the description of the specific embodiment of the invention, such axial seals can be subjected to sudden stresses of great magnitude during the rotation of the valve. The object of the present invention is to provide a means for substantially reducing the maximum bearing pressure on the axial seals.

The present invention consists of a rotary valve for an internal combustion engine comprising a hollow cylindrical valve, said valve having one or more ports terminating as openings in its periphery, said valve being supported for rotation in a cylinder head bore in which said valve rotates with a predetermined small clearance fit, said openings periodically passing over a window in said cylinder head bore, said window communicating with a combustion chamber, said valve being sealed against leakage of gas from the combustion chamber in a circumferential direction by means of axially extending seals at least one circumferentially on each side of said window, characterized in that the valve also incorporates at least one tongue projecting from the leading edge of at least one of the openings, the tongue extending from the edge of an opening to an extent sufficient to support radially one or more of the axially extending seals during that period when the leading edge of the opening crosses such seals.

In order that the nature of the invention may be better understood a preferred form thereof is hereinafter described by way of example with reference to the accompanying drawings in which.

Figure 1:
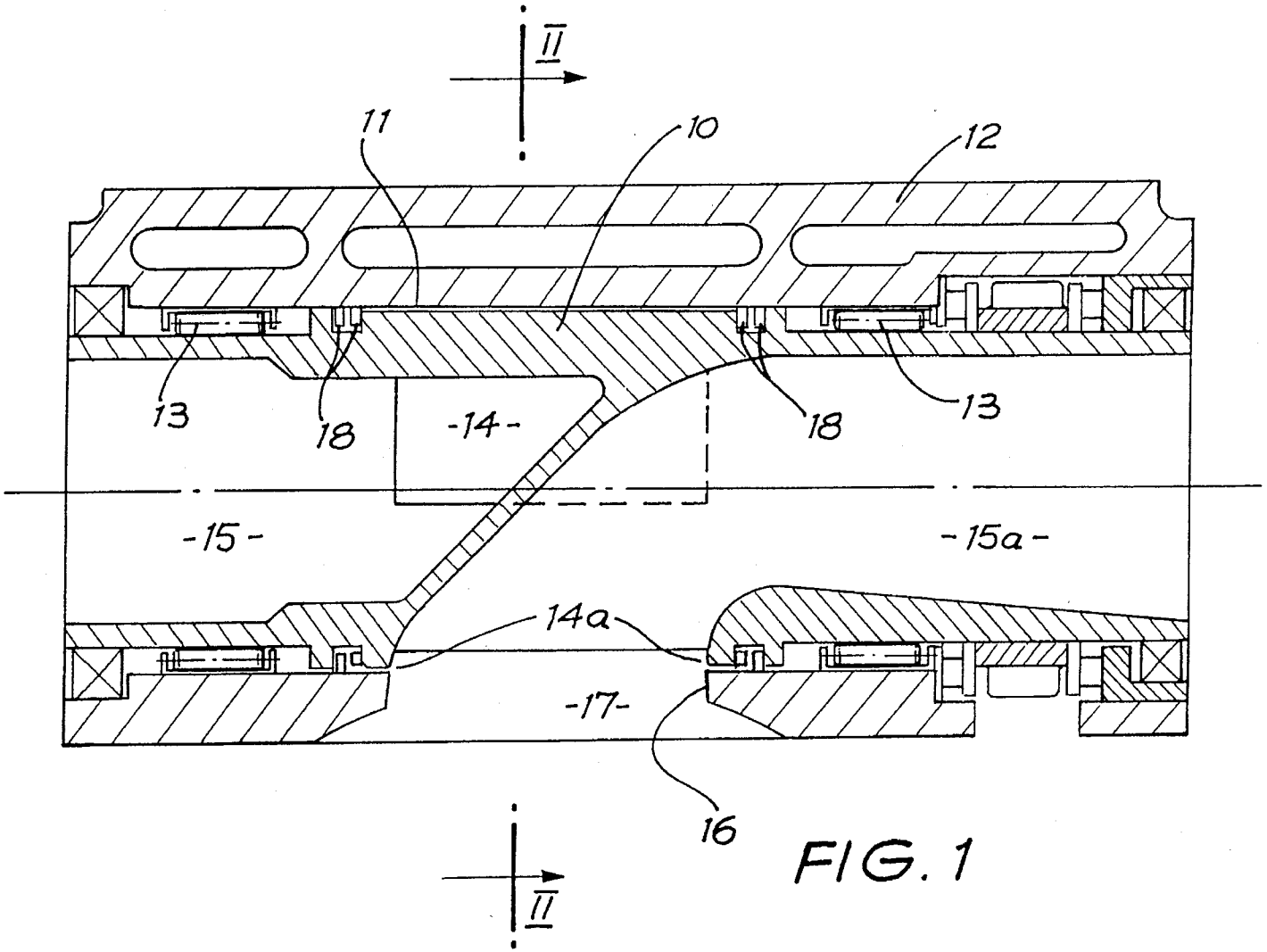
FIG. 1 is a longitudinal cross-sectional view of a rotary valve to which the invention relates.

In the drawings rotary valve 10 is supported for rotation in bore 11 of cylinder head 12 by roller bearings 13 so that there is a very small clearance between the circumferential surface of valve 10 and bore 11. Exhaust opening 14 in valve 10 connecting to exhaust port 15 coincides once during each revolution of the valve with window 16 in cylinder head 12 leading to combustion chamber 17. In another portion of the revolution of valve 10, as specifically shown in FIGS. 1 and 2, inlet opening **14*a*, coincides with window 16 and hence communicates combustion chamber 17 to inlet port 15*a***.

Figure 2:
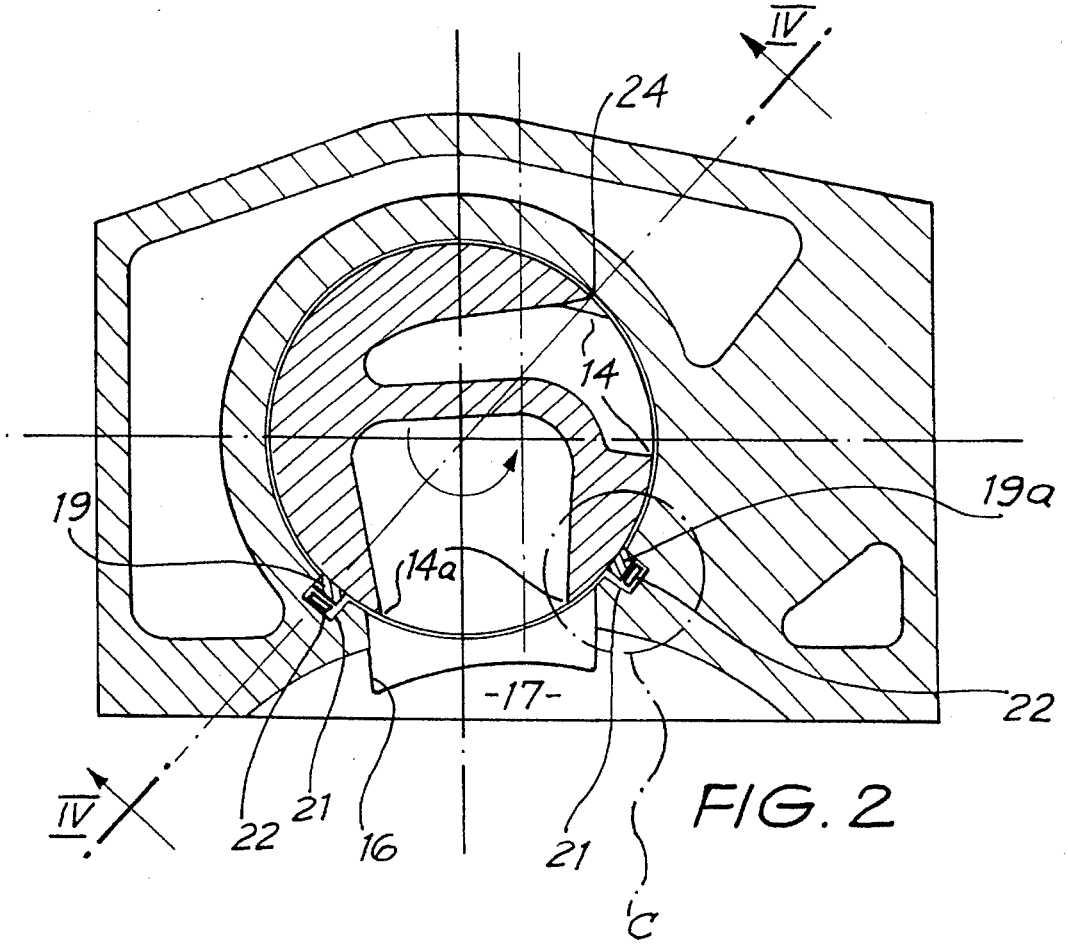
FIG. 2 is a sectional view on line A—A of FIG. 1.

Passage of gas from combustion chamber 17 along bore 11 in an axial direction is prevented by circumferential seals 18. Passage of gas from combustion chamber 17 in a circumferential direction is prevented by the axially extending seals 19 and **19*a* (FIG. 2). These are accommodated in blind slots 21 and are preloaded into contact with the surface of valve 10 by leaf springs 22, the surface of axial seals 19 and 19*a* that contact the surface of rotary valve 10** are radiused to conform closely with that surface.

Figure 3:
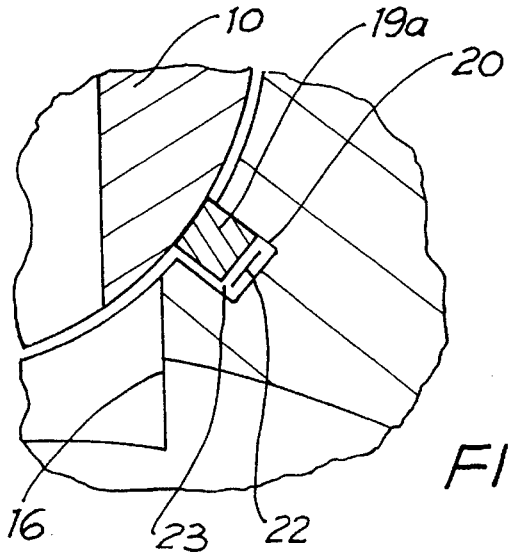
FIG. 3 is a fragmentary sectional view of portion C in FIG. 2.
Figure 4:
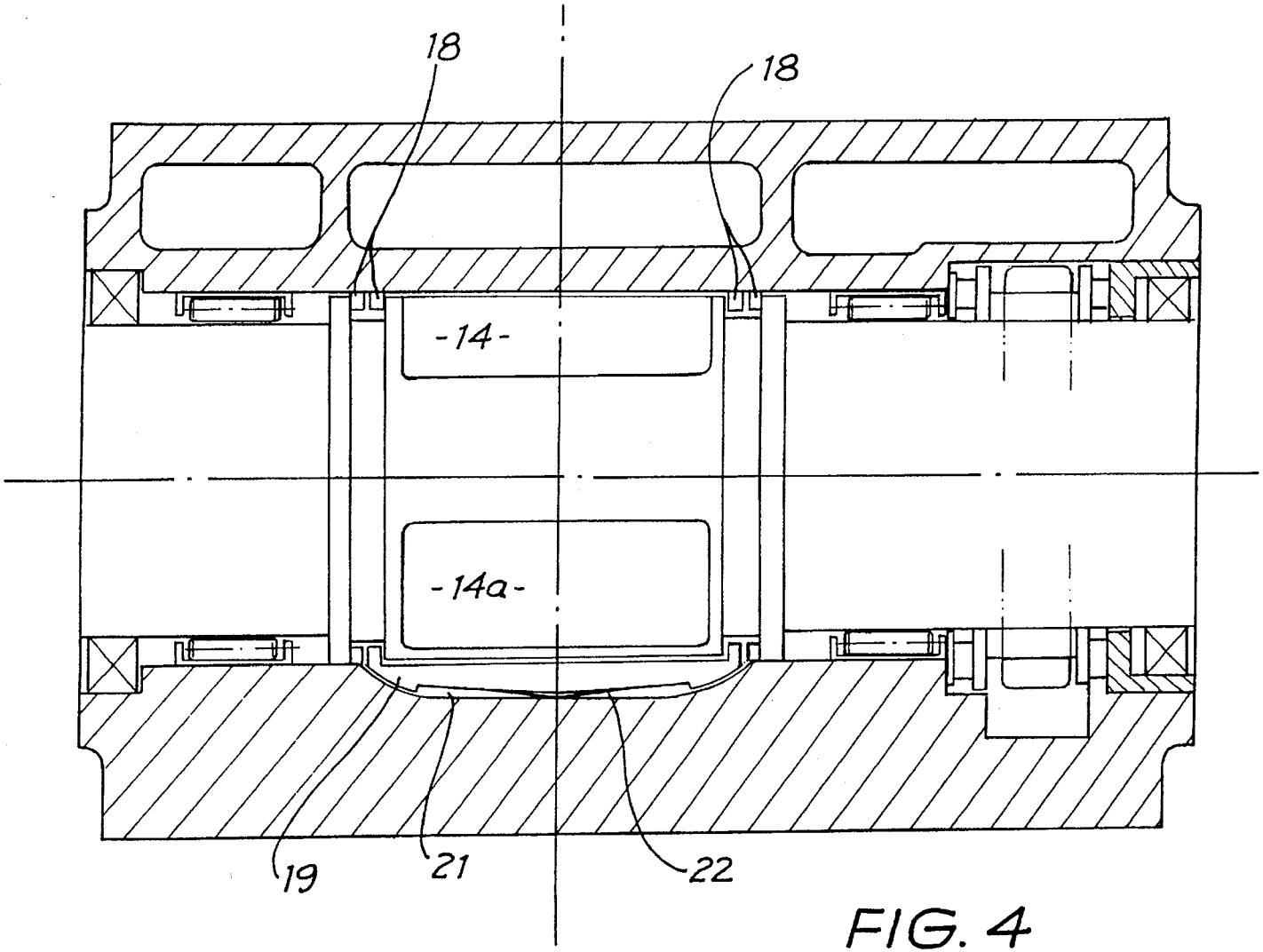
FIG. 4 is a sectional view on line B—B of FIG. 2.

During the induction and exhaust strokes the only mechanism effecting the contact between valve 10 and each axial seal 19 or **19*a* is the preload on spring 22. On the compression and combustion strokes the high pressure gas from combustion chamber 17 enters cavity 23 and forces axial seal 19 and 19*a* into sealing contact with outer wall 20 of slot 21 (FIG. 3). In addition, the pressure under axial seal 19 and 19*a* forces the axial seals against rotary valve 10. As the surface of the axial seal is contoured to conform to the surface of valve 10**, the bearing pressure between the axial seal and the valve is the same as the cylinder pressure which is forcing the axial seal into contact with the valve. Cylinder pressure could reach 1200 psi or even more in some circumstances.

Thus, during the compression and power strokes, the bearing pressure between axial seals 19 and **19*a* and valve 10** is limited to that of the cylinder pressure.

Figure 5:
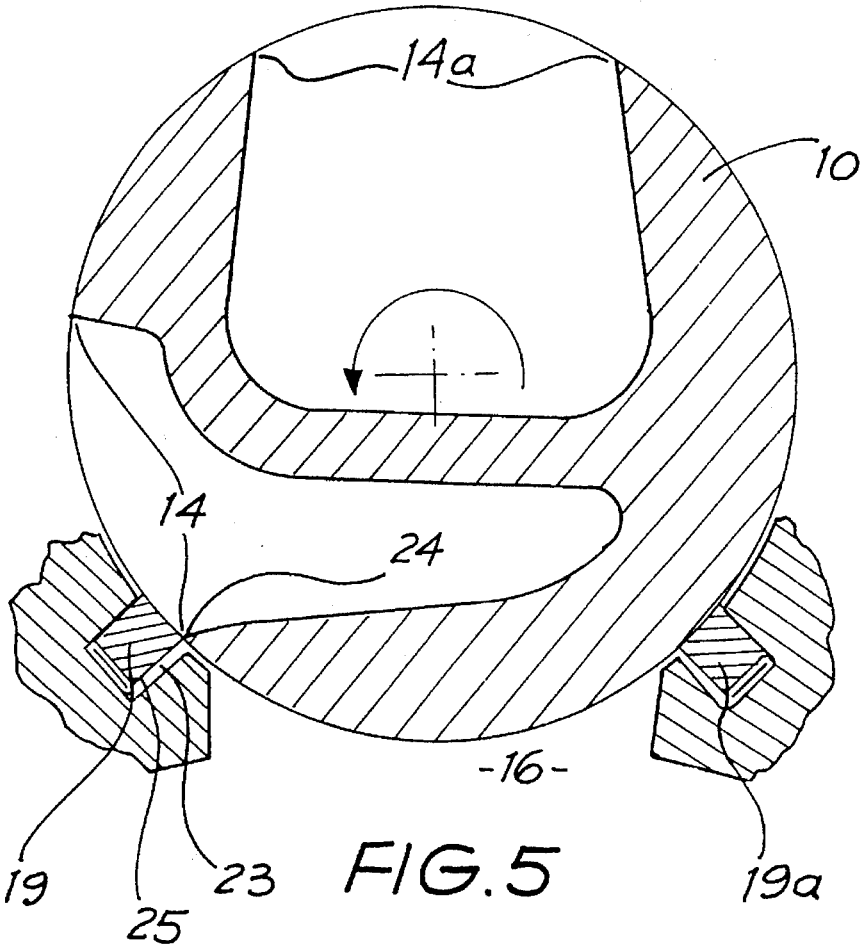
FIG. 5 is a diagrammatic sectional view of the valve as the leading edge of the exhaust opening passes over an axial seal.
Figure 6:
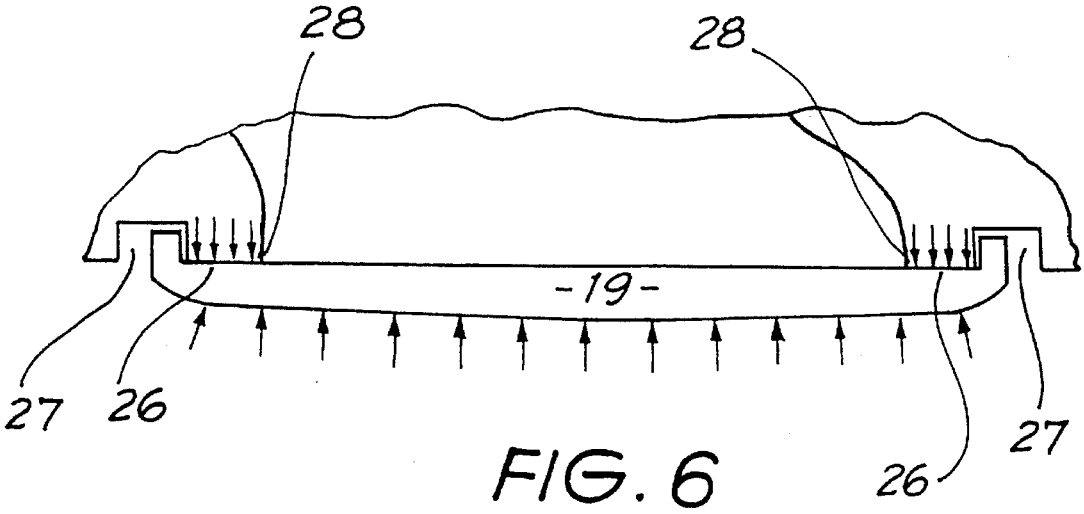
FIG. 6 is a diagrammatic view of an axial seal and the adjacent portion of the valve illustrating forces acting.

However this situation is substantially altered during the period just prior to exhaust opening 14 coinciding with the window 16. Once leading edge 24 of exhaust opening 14 starts to traverse leading axial seal 19, the bearing area between valve 10 and axial seal 19 is greatly reduced. As leading edge 24 of exhaust opening 14 has not yet passed the inner face 25 of the axial seal 19 full cylinder pressure still exists behind the axial seal 19. The most highly loaded situation occurs just prior to the coincidence of exhaust opening 14 with window 16 i.e. as leading edge 24 of exhaust opening 14 crosses inner face 25 of axial seal 19. This situation is shown in FIG. 5. The load on the underside of axial seal 19 is now reacted by the axial seal bearing on narrow bands 26 of the valve surface located axially outboard of the axial extremities of exhaust opening 14 and inboard of circumferentially extending grooves 27 housing circumferential seals 18 (FIG. 6).

Typically these narrow bands 26 have their width minimized to minimize the crevice volume. They are typically 6 mm wide. Their combined width is typically less than 20% and greater than 14% of the total axial seal length. Assuming the load on the axial seal is uniformly distributed over these narrow bands 26, the average pressure will be increased by a factor of between 500 and 700 percent. As the cylinder pressure is typically 60 psi when the exhaust valve opens the average bearing pressure is increased to approximately 400 psi still well short of that pertaining during the combustion stroke. However as the axial seals are slender they will deflect in the fashion of a beam simply supported by the surface at edges 28 of the exhaust opening 14. This results in a very large line loading along edges 28.

Figure 7:
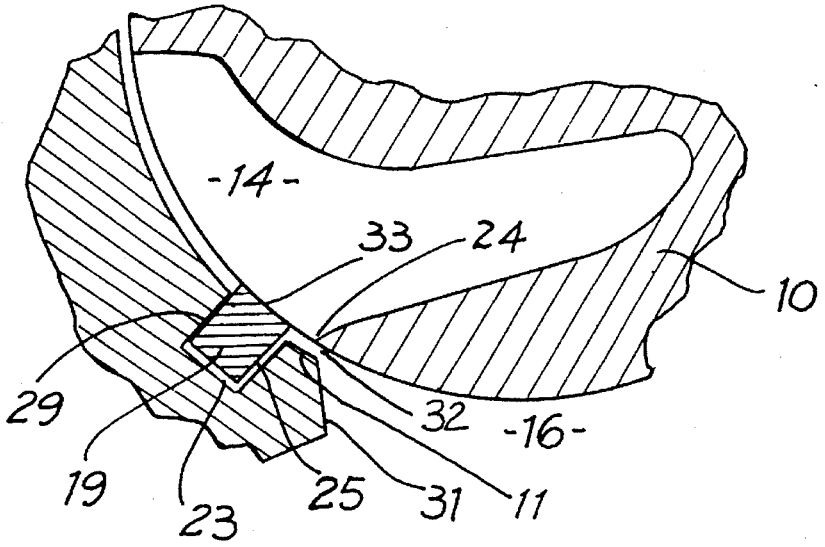
FIG. 7 is a view similar to FIG. 5 at a later stage in rotation of the valve.
Figure 8:
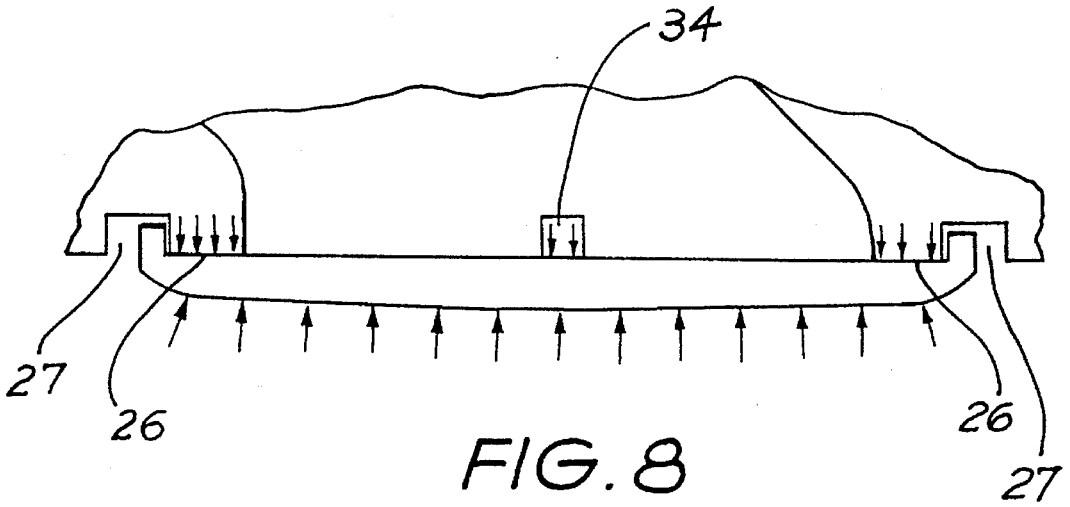
FIG. 8 is a view similar to FIG. 6 illustrating the effect of the tongue provided by the invention.

Once leading edge 24 of exhaust opening 14 rotates past inner face 25 of axial seal 19, exhaust opening 14 is in direct communication with cavity 23 and the pressure behind axial seal 19 collapses. This condition is shown in FIG. 7. There is typically a period of approximately 12 crankshaft degrees between the leading edge 24 of exhaust opening 14 passing inner face 25 of axial seal 19 and its passing inner face 31 of the window 16. During this period the flow of cylinder gas from the combustion chamber is limited to that which can flow through space 32 formed by the small radial clearance between the circumferential surface of valve 10 and cylinder head housing bore 11. Cavity 23 around the axial seal is however directly exposed to exhaust opening 14 during this period and the pressure behind axial seal 19 collapses very rapidly as a result. Once this pressure has collapsed the pressure under the axial seal assumes the same magnitude as the pressure in exhaust opening 14. This pressure acts directly on upper surface 33 of axial seal 19 and so counteracts the pressure under axial seal 19.

The situation is then once again one in which the bearing pressure between axial seal 19 and narrow bands 26 of the valve surface which support axial seal 19 has reverted to the same magnitude as in cavity 23. There is no longer any bending moment causing seal deflection and load concentration.

From the above analysis it is apparent that there is a very large increase in bearing pressure suffered by axial seal 19 for a small number of crankshaft degrees (typically 12–20 crankshaft degrees) just prior to the coincidence of exhaust opening 14 with window 16. This is a result of the greatly reduced bearing area (500–700%) and the line concentration of the reaction load due to bending of the simply supported axial seals 19.

This invention minimizes the concentration of the reaction load by supporting the axial seal by means of a narrow tongue 34 located in the center of exhaust opening 14. This tongue 34 projects into the center of opening 14 by an angle A (see FIG. 10) where A is greater than B (see FIG. 11)—the angle contained between outer face 29 of axial seal 19 and inner face 25 of the axial seal 19 and less than the angle C contained between outer face 29 of axial seal 19 and face 31 of window 16 immediately adjacent this axial seal (see FIG. 11).

Figure 10:
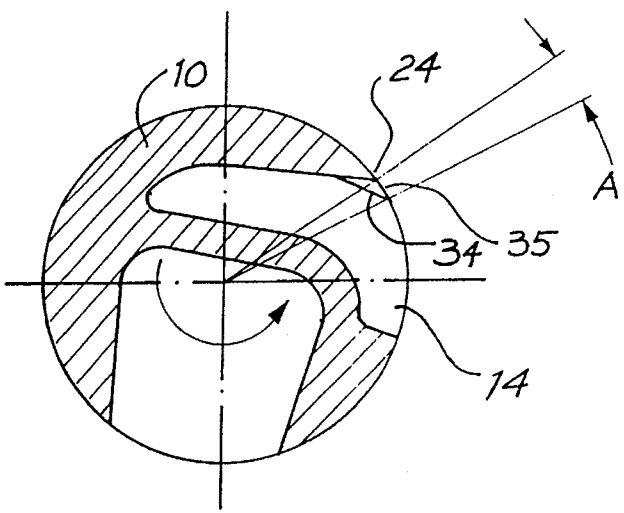
FIG. 10 is a sectional view on line D—D of FIG. 9.
Figure 9:
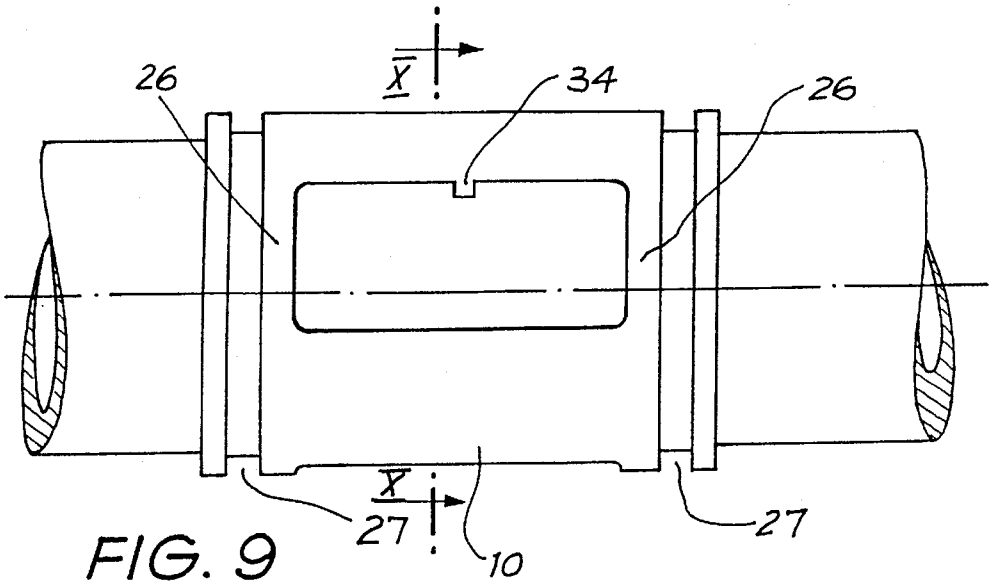
FIG. 9 is a side view of the rotor showing the tongue provided by the present invention.
Figure 11:
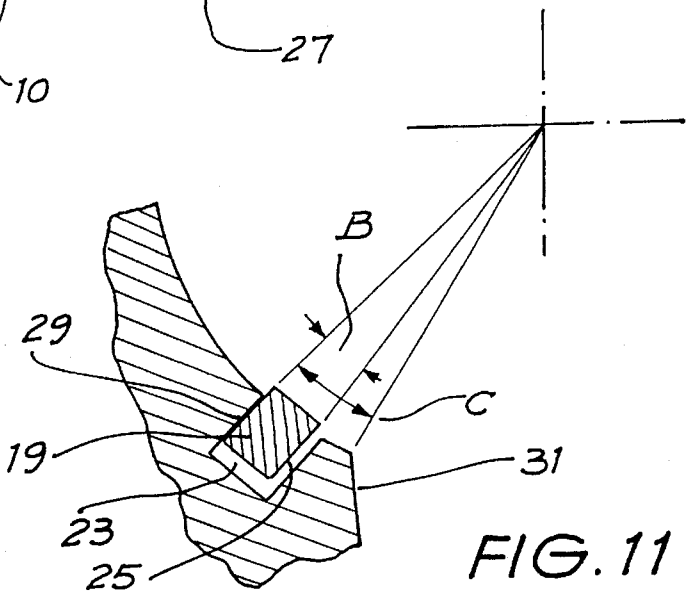
FIG. 11 is a diagram illustrating the annular extent of the tongue.

The outer surface of tongue 34 has the same profile as that of outer cylindrical surface 35 of valve 10 (FIG. 10). Tongue 34 supports the center of axial seal 19 during that period when leading edge 24 of exhaust opening 14 crosses axial seal 19. It prevents the deflection of the center of axial seal 19 and the resultant line concentration of load on edges 28 (FIG. 6) of exhaust opening 14. There is still deflection occurring but is now minimal—i.e. in the order of 2.5 percent of that previously prevailing. As the degree of load concentration is a function of the axial seal deflection it will be seen that the supporting action of the tongue will greatly reduce this problem.

The axial width of tongue 34 can be narrow whilst still maintaining an acceptable bearing pressure. It can be shown that the width of the tongue can be as little as 12% of the overall axial seal length, whilst still maintaining a bearing pressure of 300 psi, or approximately one third that experienced during the combustion phase, where cylinder pressure can reach 1200 psi or greater.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A rotary valve for an internal combustion engine comprising a hollow cylindrical valve, said valve having one or more ports terminating as openings in its periphery, said valve being supported for rotation in a cylinder head bore in which said valve rotates with a predetermined small clearance fit, said openings periodically passing over a window in said cylinder head bore, said window communicating with a combustion chamber, said valve being sealed against leakage of gas from the combustion chamber in a circumferential direction by means of axially extending seals at least one circumferentially on each side of said window, characterized in that the valve also incorporates at least one tongue projecting from the leading edge of at least one of the openings, the tongue extending from the edge of an opening to an extent sufficient to support radially one or more of the axially extending seals during that period when the leading edge of the opening crosses such seals.

2. A rotary valve as claimed in claim 1 wherein one tongue projects from an axially central point on the leading edge of at least one of the openings.

3. A rotary valve as claimed in claim 1 wherein the external surface of at least one said tongue has the same diametral profile as the outer cylindrical periphery of said valve.

4. A rotary valve as claimed in claim 1 wherein at least one said tongue extends from the leading edge of an opening to such an extent as to subtend at the rotational axis of the valve an angle greater than the angle subtended by the width of the radially supported axial seal but less than the angle subtended by the distance between the circumferentially outermost face of the radially supported axial seal and an adjacent face of the window.

5. A rotary valve as claimed in claim 1 wherein at least one said tongue extends from the leading edge of the exhaust opening.

* * * * *